United States Patent [19]

Yamasaki

[11] 4,142,237

[45] Feb. 27, 1979

[54] PROCESS FOR TRACKING A WELDED JOINT IN A CONTINUOUS LONG MATERIAL IN A PRODUCTION LINE

[75] Inventor: Ikutaro Yamasaki, Ibaragi, Japan

[73] Assignee: Sumitomo Kinzoku Kogyo Kabushiki Kaisha, Osaka, Japan

[21] Appl. No.: 819,198

[22] Filed: Jul. 26, 1977

[30] Foreign Application Priority Data

Aug. 5, 1976 [JP] Japan ..... 51-93799

[51] Int. Cl.[2] ..... G01B 7/34; B21C 51/00

[52] U.S. Cl. ..... 364/469; 228/5.7; 228/104; 364/507

[58] Field of Search ..... 364/469, 472, 506, 507, 364/508; 235/92 CC, 92 DN, 92 MT; 228/5.7, 104

[56] References Cited

U.S. PATENT DOCUMENTS

| | | | |
|---|---|---|---|
| 3,681,523 | 8/1972 | Sidline | 235/92 CC |
| 3,714,393 | 1/1973 | Johnson et al. | 235/92 DN |
| 3,774,016 | 11/1973 | Sterns et al. | 364/469 |
| 3,824,694 | 7/1974 | Lesperance et al. | 235/92 DN |
| 3,835,681 | 9/1974 | Shumaker | 228/5.7 |
| 4,052,599 | 10/1977 | Whiteley et al. | 364/469 |
| 4,053,755 | 11/1977 | Sherrill | 235/92 DN |

FOREIGN PATENT DOCUMENTS

| | | | |
|---|---|---|---|
| 1773432 | 7/1971 | Fed. Rep. of Germany | 235/92 DN |
| 2157561 | 6/1972 | Fed. Rep. of Germany | 228/104 |
| 5167677 | 6/1976 | Japan. | |

OTHER PUBLICATIONS

Nosaka: Computer Control in Iron and Steel Industry, Computer Science Series, Publ: Saugyo Tosho Kabushiki Kaisha, pp. 243/244, 1970.

Employment of Computer in Zinc Plating Line, Metal Surface Technique, Edit. Metal Surface Technique Assoc., vol. 21, No. 2, 1970, pp. 38/42.

Noe et al.: Computer Control of Zinc-coating Weight on the Fairfield, No. 4 Galvanizing Line, Int. Fed. of Automation Control-Preprint part II c. Plate Rolling and Timing session, 1975, 46.2, pp. 1-8.

*Primary Examiner*—Felix D. Gruber

*Attorney, Agent, or Firm*—Ladas, Parry, Von Gehr, Goldsmith & Deschamps

[57] ABSTRACT

A continuous production line is divided into a plurality of zones, with each of which there is associated a presettable counter. An anticipated length of a material, which has been calculated from information regarding the material before welding, is converted into a given number of pulse signals, which in turn are preset in the counter, with its timing being shifted a zone to zone distance. Long materials which have been sequentially joined by welding into a continuous length of material are fed into the production line, and the length of material actually fed is detected by means of a feed length gage, and an output of the gage is converted into a pulse signal. The length of the material actually fed is substracted from the anticipated length of the material, i.e., the preset count value, as the material is being fed. Thus, it is presumed that a welded joint across the length of material is present in the zone where a preset count value becomes zero as a result of the aforesaid subtraction. This presumption is further corrected by means of a welded joint detecting means provided in a given position in the production line. The welded joint detecting means is provided in the form of an X-ray thickness gage or temperature detector for non-contacting detection, without subjecting the material to physical or chemical working.

16 Claims, 13 Drawing Figures

PROCESS FOR TRACKING A WELDED JOINT IN A CONTINUOUS LONG MATERIAL IN A PRODUCTION LINE

BACKGROUND OF THE INVENTION

This invention relates to a process for detecting and tracking a welded joint in a length of material to be processed in a continuous production line, i.e., a so-called tracking process, for a continuous steel material such as in a continuous steel pipe production line, continuous hot dipping line, continuous annealing line, continuous pickling line and the like.

It has hitherto been proposed that in a steel pipe production plant, such as a forged steel pipe line, steel strips in the form of a coil should be welded together end to end for feeding same through a continuous production line.

The welded joints thus produced are unique in their mechanical strength and in their appearance, as compared with the rest of the steel strips.

In addition, there tends to take place a variation in the thickness between the steel strips upstream and downstream of a welded joint due to the limited accuracy of thickness control in the preceding processing of the steel strip, i.e., in the rolling thereof.

Although the technique of welding at the present time is highly developed, it is preferred that welded joints not be included in a product which is being delivered from the output of a production line, for reasons of both mechanical strength and appearance. Nevertheless, the welded joints are of importance in the automatic control of a production line.

Hitherto, manual means have been resorted to for recognition or detection of welded joints moving along a production line. In addition, even in the case of an automatic production line, suitable markings have been put on welded joints of a continuous length of material for subsequent detection by a detecting means located in a suitable position for tracking and detecting the movements of welded joints. As a marking method, a hole may be drilled in the neighborhood of a welded joint in a material, or a paint or magnetic substance may be applied thereto. However, drilling the material imparts a serious defect to the quality of the final product and may pose many problems in working and strength, while a paint or a magnetic substance may not be used for a production line including heat treatment.

The visual recognition or detection of a welded joint by an operator may lead to error, particularly in view of the improved appearance of welded joints owing to progress in welding technology, and requires an expenditure of man power, with accompanying reduced efficiency and poor accuracy of recognition.

It is a principal object of the present invention to provide a process for tracking a welded joint in a continuous length of a material passing through a continuous production line by detecting a welded joint accurately automatically.

It is a further object of the present invention to clarify the relationship between the results of tracking and respective equipments provided in a production line.

It is a still further object of the present invention to provide a method for correcting an error of the results of tracking.

It is a further object of the present invention to provide a method for setting a gate for use in the aforesaid error correcting method.

It is a further object of the present invention to provide a presumption method for an anticipated length of material extending from one welded joint to the next welded point.

It is a further object of the present invention to provide a detecting method for a welded joint.

It is a further object of the present invention to provide an assembly of a detector for a welded joint.

It is a further object of the present invention to provide a continuous production line to which the tracking process of the present invention is applied.

It is a further object of the present invention to provide processing of tracking information.

It is a further object of the present invention to provide a method for setting a presettable counter.

It is a further object of the present invention to provide a method for utilizing the results of tracking.

DESCRIPTION OF THE PREFERRED EMBODIMENTS

The present invention will be described in more detail with reference to the accompanying drawings which indicate preferred embodiments of the invention.

Figure 1:
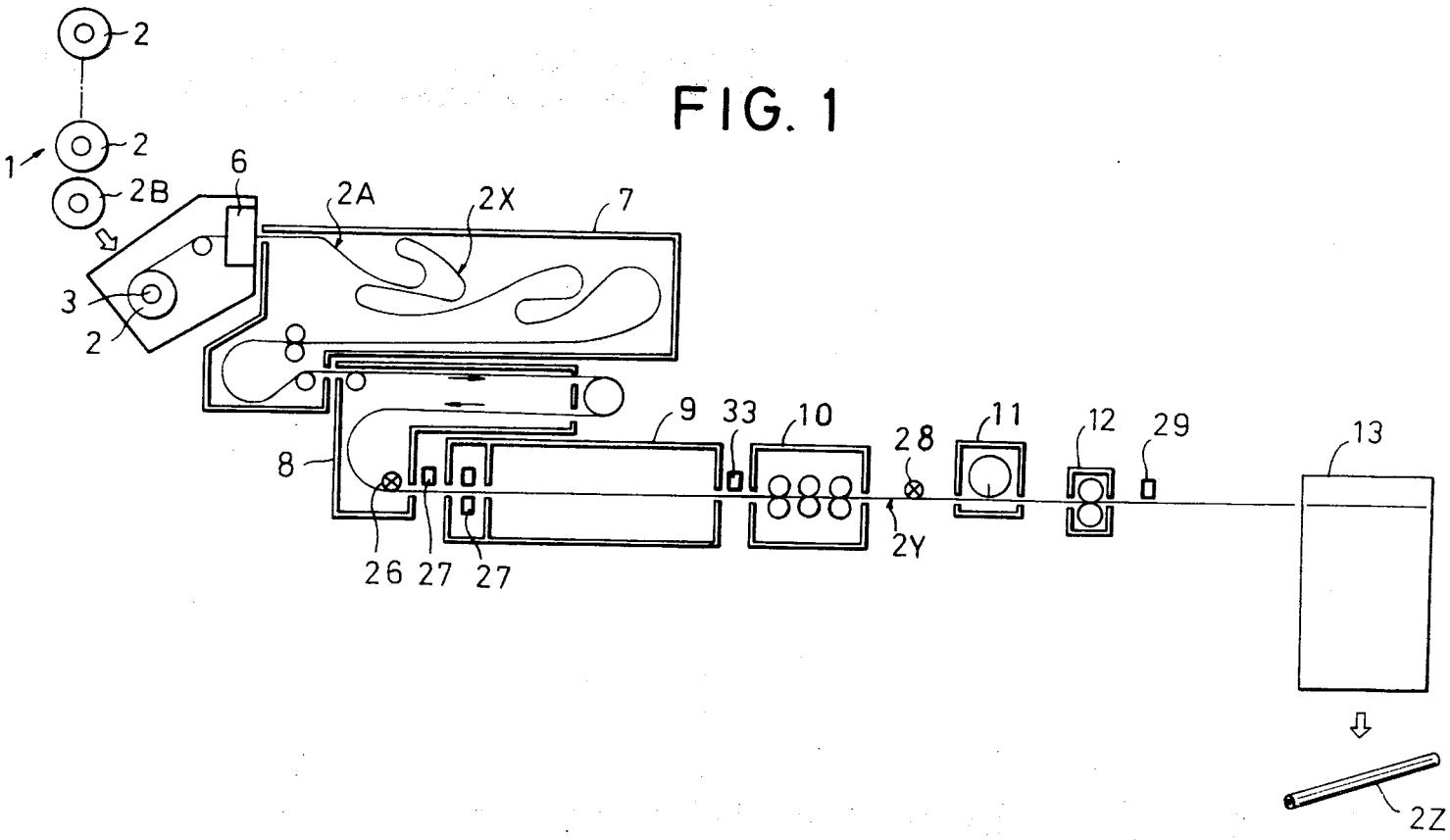
FIG. 1 is a schematic diagram of a forged-pipe production line embodying the present invention.

DESCRIPTION OF ONE EXAMPLE OF A PRODUCTION LINE EMBODYING THE INVENTION:

FIG. 1 shows a forged-pipe production line provided with a series of pipe manufacturing equipments.

Shown at 1 is a material entry station, through which coils 2 of steel strip are fed in sequence. The coils are uncoiled by means of a pay-off reel or uncoiler reel 3.

Figure 2:
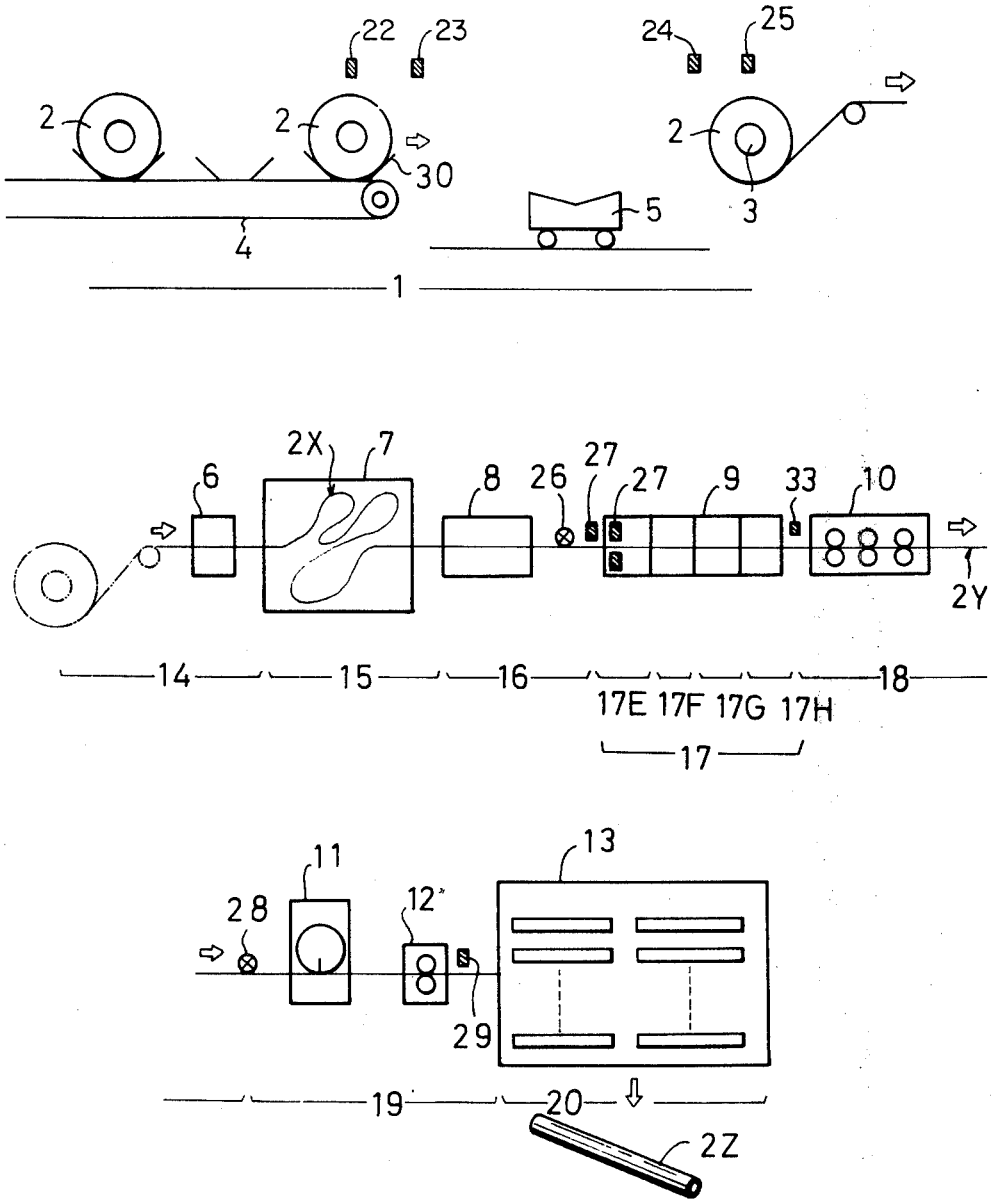
FIG. 2 is a view illustrative of a setting condition of detectors which are arranged along the production line, and the set condition of zones.

Provided for the material entry station 1 are a conveyor 4 and a coil car 5 as shown in FIG. 2, by which each coil 2 is transported. The coil 2 at the uncoiler reel 3 is uncoiled and the uncoiled steel strip is delivered to a production line, and then the terminating end of a leading coil 2A is joined to the starting end of a trailing coil 2B by the welder 6 into a continuous long steel strip 2X.

The continuous long steel strip 2X is stocked in some amount in a loop floor 7 which allows continuous production in the production line, without interrupting the operation of a series of equipments, and then the strip 2X is fed into a preheating oven 8 and then into a heating oven 9 to be heated therein.

The continuous long steel strip 2X is roll-formed at a mill 10 into a continuous forged-pipe 2Y, and then cut to a given length by means of a rotary hot saw 11.

Then, the forged pipe 2Y is finished to a given outer diameter and dimensions at a sizer 12, and then fed to a cooling bed 13. In this manner, a forged pipe 2Z conforming to a given specification is continuously produced in the production line.

DESCRIPTION OF WELDED-JOINT TRACKING:

As has been described earlier, welded joints A are present in the continuous long steel strip 2X, continuous forged pipe 2Y and some sections of forged pipe 2Z.

According to the tracking process of the invention for welded joints, the production line is divided into two or more zones corresponding to respective equipments for processing of welded joint detecting signals.

As shown in FIG. 2, the production line is divided into a welder zone 14, a loop floor zone 15, a preheating zone 16, a heating zone 17, a mill zone 18, a transporting zone 19 and a cooling bed zone 20, and further the heating zone 17 is divided into four zones 17E to 17H.

Figure 4:
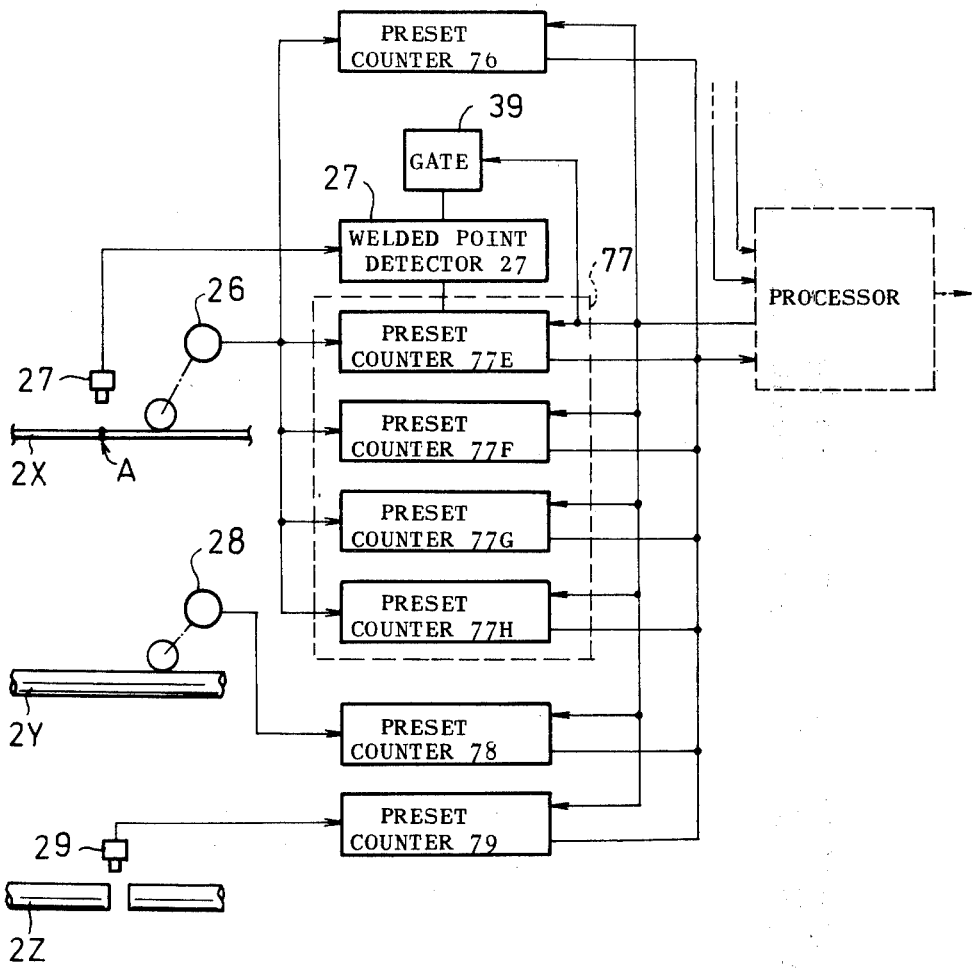
FIG. 4 is a block diagram showing the relationship between the detectors and the like, and the presettable counters.

One each of presettable counters 76 to 79 shown in FIG. 4 is provided for each of the zones 16 to 19. The presettable counters 76 to 79 are functionally provided in the form of software in computer 21, but may be literally provided as a hardware.

Provided in the material entry station 1 are limit switches, preferably photoelectric switches or two or more material detectors 22, 23, 24, and 25. The reason for the provision of two or more material detectors is to closely detect the transporting condition of the coil 2 at the material entry station 1. In this embodiment, a detector 22 is provided at a terminating portion of the transporting conveyor 4 in opposed relation thereto, detectors 23, 24 are provided in opposed relation to the coil car 5 for detecting the travelling of the car, and a detector 25 is provided for detecting if the coil is placed at the uncoiler reel 3.

In this respect, the number of material detectors may be increased or reduced depending on the arrangement of equipments provided at the material entry station 1.

Provided between the preheating oven 8 and the heating oven 9 more particularly, on the output side of the preheating oven 8, is a feed length gage 26 for measuring the feed length of the steel strip 2X, while a welded-joint detector 27 is provided on the input side of the heating oven 9. The welded-joint detector 27 and 33 will be described in more detail hereinafter.

A pipe-velocity meter 28 is provided between the mill 10 and the rotary hot saw 11 for detecting the feeding rate or velocity of the forged pipe 2Y, while a pipe counter 29 is provided on the input side of the cooling bed 13 for counting the number of forged pipes 2Z cut by the rotary hot saw 11.

Figure 3:
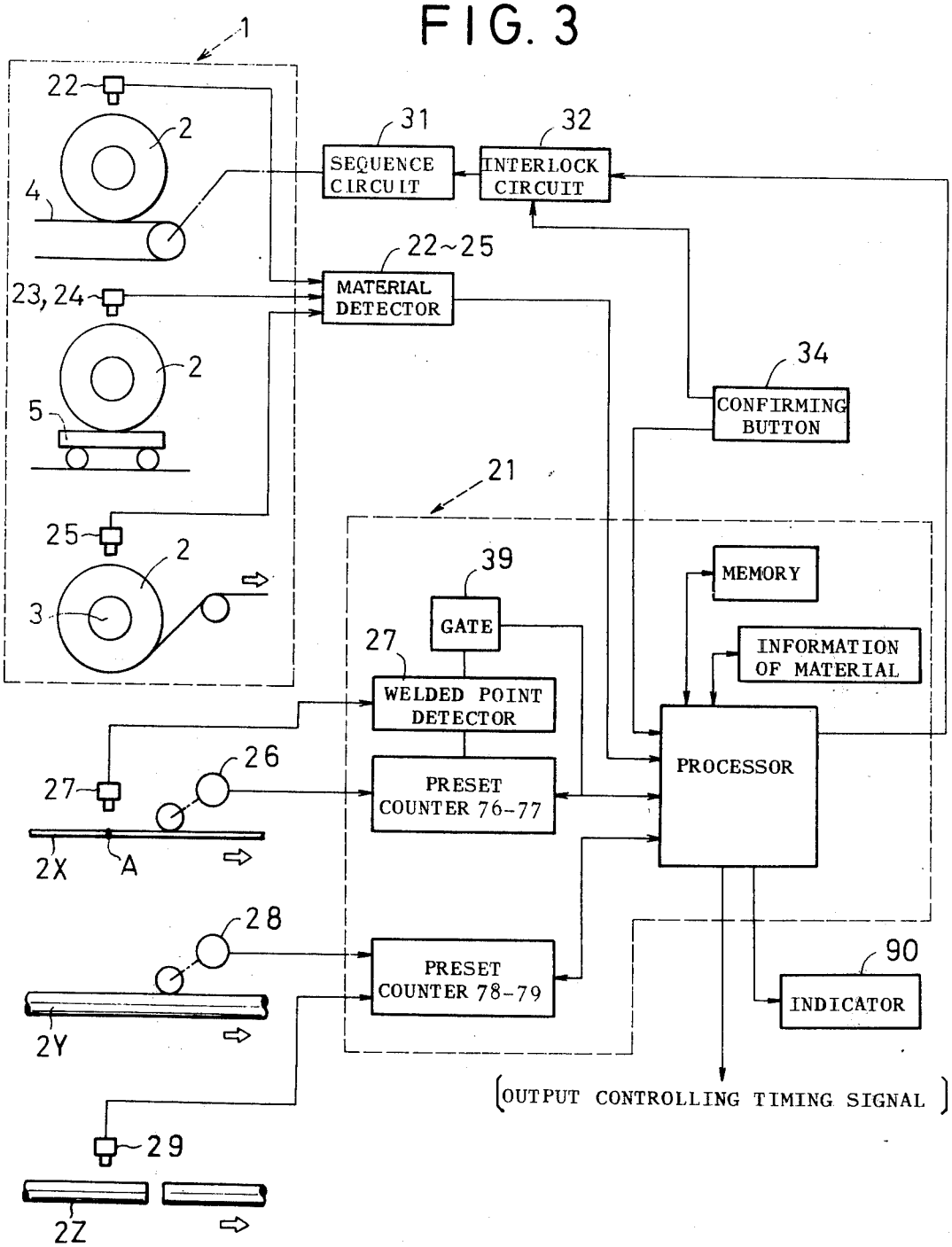
FIG. 3 is a block diagram showing the relationship between the detectors and the like, and a computer.

The information fed from the aforesaid respective detectors and the like is fed into the computer 21 and processed on a real time basis by a programmable data processor indicated in FIGS. 3 and 4 by the block labelled PROCESSOR.

MATERIAL ENTRY

The coil is fed to the material entry station 1 according to coil feeding sequence data which has been stored in the computer.

The coil feeding condition is first detected by the material detector 22 at a saddle 30 (FIG. 2) at the end of conveyor 4, whereby the coil 2 on the saddle 30 at the end of the conveyor is compared by an operator with the coil called for by the stored feeding sequence data. In other words, a detecting signal from the material detector 22 acts as a command signal for a material indicating board (not shown) connected to the computer 21, so that the number of the coil which should be positioned on the saddle 30 is read out from the feeding sequence data and indicated on the material indicating board, and the operator compares the number of the actual coil with the number of the coil indicated.

In case the number of the actual coil does not conform to the coil number indicated, a confirming button (FIG. 3) on the material indicating board is depressed, so that conformity may be attained according to an "advance-one-coil" or "retract-one-coil" operation. The conveyor 4 may be driven under the control of a sequence control circuit 31 to which an interlock circuit 32 is connected.

Subsequently, the coil 2 thus confirmed is fed to the uncoiler reel 3 by being transported by the coil car 5. In this respect, the transportation of the coil 2 by means of the coil car 5 includes not only a mechanical operation to transport the coil from the conveyor 4 to the uncoiler reel 3, but the reverse feeding of the coil 2 or feeding of a new coil, in the event of troubles arising in the uncoiler reel 3. Accordingly, the movements of the coil from the saddle 30 to the coil car 5 and from the coil car 5 to the uncoiler reel 3 are logically determined.

TRACKING OF WELDED JOINTS

Prior to the tracking of a welded joint A, initial matching is required, because there arises a difficulty in recognizing the welded joint A on the coil 2 when, simultaneously, the computer is turned on.

Then, it is confirmed that coil data covering the distance from the welder zone 14 to the mill zone 18 have been stored in the computer 21, after which the coiled steel strip 2 attached to the uncoiler reel 3 is pulled forward to a given position on the production line. (In this embodiment, the coil should be pulled forward up to the mill 10.) Then, matching is established between the number of the coil at the mill 10, and the coil data stored in the computer 21. The aforesaid matching may be established by manually moving back or forward the coil 2 (with respect to long steel strip 2X).

Figure 11:
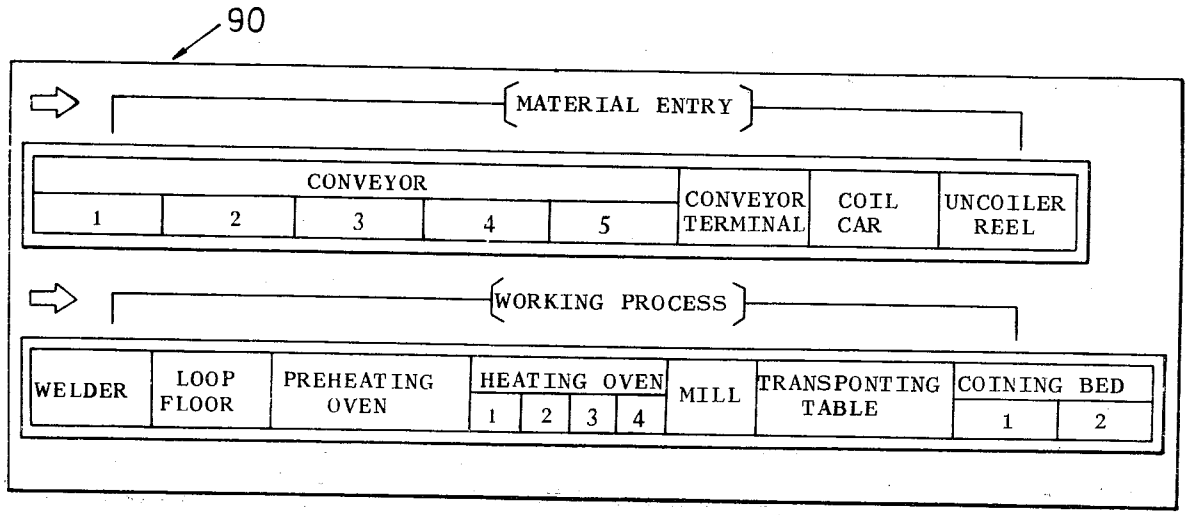
FIG. 11 is a front view of one example of an indicating means.

In this manner, operation on a production line is commenced. When the first welded joint A passes through the welded joint detector 33 provided on the input side of the mill 10, then the tracking function of the computer 21 is turned on and employed for initial matching. Meanwhile, for preventing mismatching, an operator visually confirms that the mill indicating lamp of lamps 90 (FIG. 11) is lit by the detector 33, when the first welded joint A passes through the mill 10, simultaneously with the aforesaid matching operation, and then the confirming button 34 is depressed for starting the computer 21.

Subsequent to the initial matching of the welded joint A, the tracking is continuously effected along with a continuous operation in the production line. Description will now be made of the tracking over a range from the welder zone 14 to the mill zone 18.

(I) Tracking in welder zone 14:

In welder zone 14, the leading coil 2A is automatically welded to the trailing coil 2B at their ends, and then upon completion of welding, a "welding completion signal" is fed into the computer 21. When the welding completion signal is fed, then the welded joint A is regarded as having departed from the welder zone 14 into the loop floor zone 15.

Meanwhile, in the welder zone 14, one coil is advanced per completion of each welding. In other words, the welded joint A is advanced a distance corresponding to the length of one coil.

(II) Tracking in the loop floor zone 15:

A detector for the welded joint A is not provided in the loop floor zone 15. When the coil 2 which has completed welding comes between the welding zone 14 and the preheating zone 16, then the welded joint A is regarded as being within the loop floor zone 15. Accordingly, a coil of a length corresponding to the difference between the length of coil fed from the welding zone 14, i.e., the distance of the welded joint A which has been advanced, and the length of a coil which has been advanced into the preheating zone 16 is within loop floor zone 15.

Figure 5:
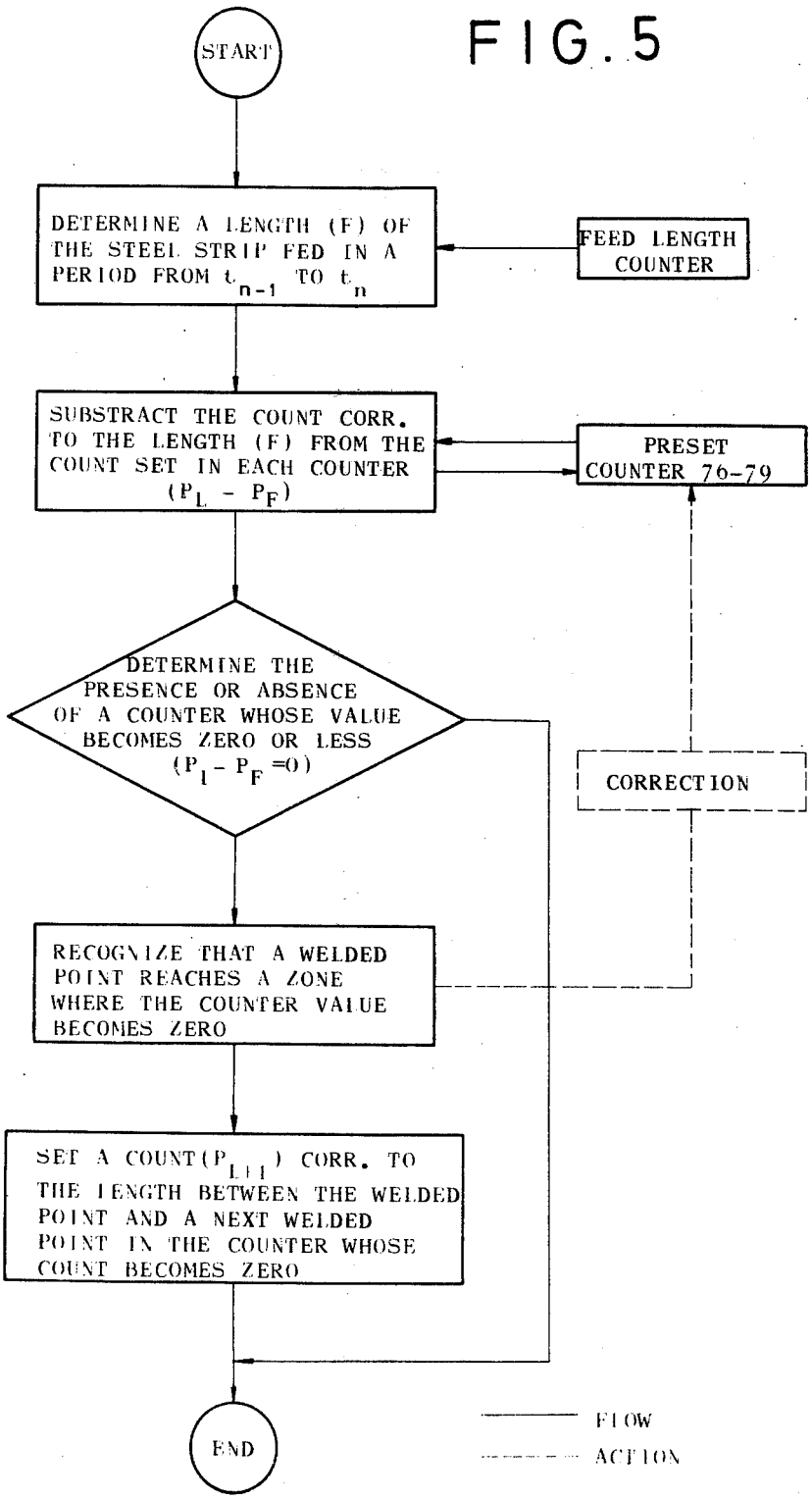
FIG. 5 is a flow chart illustrative of the information-processing steps in tracking.
Figure 6:
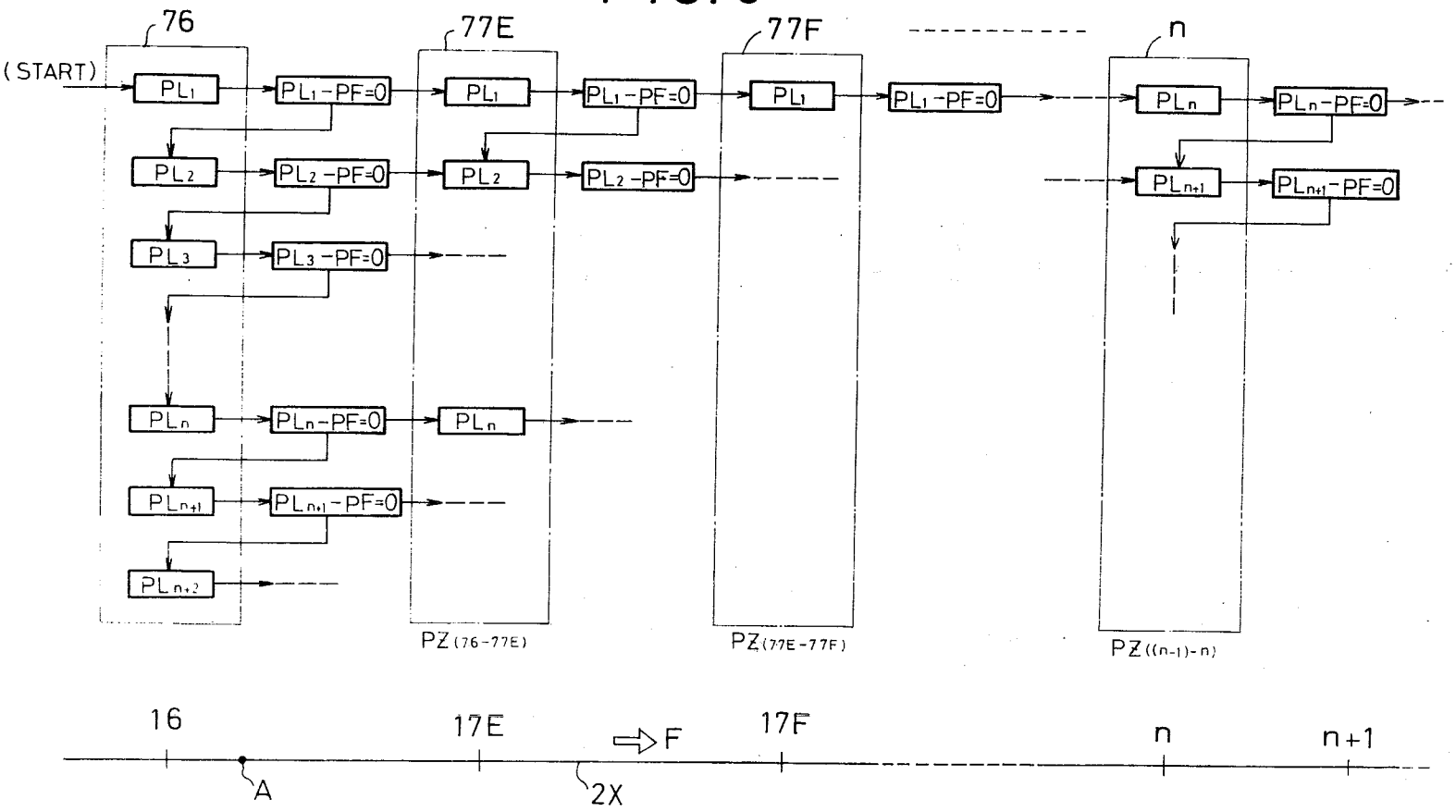
FIG. 6 is a diagram illustrative of the preset condition of a count value corresponding to a distance between welded joints.

(III) Tracking a welded joint in a range from the preheating zone 16 to the mill zone 18:

The tracking in a range from the preheating zone 16 to the mill zone 18 will be described with reference to FIGS. 4 to 6.

When the first welded joint A passes through the welded joint detector 33 in the mill zone 18, then the initial matching is made, whereupon pulse signals PL1 to be described later, of a number corresponding to the anticipated length of the continuous long steel strip 2X to be fed are supplied to the respective presettable counters 76 to 78 associated with the preheating zone 16 and the mill zone 18.

At this time, the pulse signal PL1 is set, with its timing being shifted by a pulse number PZ corresponding to the distance between a adjoining zones of the counters 76 to 78. The pulse number PZ is stored in the computer 21 beforehand.

When the welded joint A is moved at a given speed continuously, a signal representing the feed length F of the continuous long steel strip 2X is fed from the feed length gage 26, and then the feed length signal is converted into a pulse signal PF. Then, the pulse signal PF thus converted in turn is subtracted from the preset pulse signal PL1, with the moving of the welded joint A.

As a result, it is recognized that the welded joint A is present in a zone where PL − PF = 0 is found, as the result of subtraction in the presettable counters 76 to 78. Meanwhile, that pulse number PZ corresponding to a distance between the adjoining zones (for instance, zones 16 and 17E, or zones 17E and 17F) remains in a presettable counter where the preset count value PL becomes zero as the result of subtraction (PL − PF = 0).

In this respect, the anticipated length L of the continuous long steel strip 2X may be given by the following equation from the weight and certain dimensions of coil, which have been measured beforehand:

$$L = \alpha \times \frac{W \times 10^{-2}}{\rho b t} \; [m] \qquad (1)$$

wherein

W: weight of coil (g)

b: width of coil (cm)

t: thickness of coil strip (cm)

$\rho$: specific weight = 7.9 (g/cm$^3$)

$\alpha$: compensating coefficient $\approx$ 1 (experimental value)

When the preset count value PL1 in the preset counter 76 in the preheating zone 16 provides a relationship PL1 − PF = 0, then the preset value PL1 is set in the presettable counter 77E in the subsequent heating zone 17, and the signal PF from the feed length gage 26 is subtracted. On the other hand, a pulse number PL2 corresponding to the anticipated length L2 of the trailing continuous long steel strip 2X is set in the counter 76 in the preheating zone 16, i.e., in a zone where PL − PF = 0.

In a similar manner to the aforesaid case, the welded joint A is recognized, when PL2 − PF = 0, and then preset value PL2 is set in the presettable counter 77E in the subsequent zone 17, i.e., the preset value of the trailing continuous long steel strip 2X is set, following the leading continuous long steel strip 2X. FIG. 6 is presented to aid in the understanding of the aforesaid presetting condition.

Meanwhile, the anticipated length L of the continuous long steel strip shown earlier is likely to involve some error, because of the use of nominal dimensions, such as width b and thickness t. These errors will be accumulated in a continuous production line of a long distance, thereby presenting a danger of impairing the accuracy of tracking.

The errors having a given or constant tendency may be compensated for to some extent by selecting a compensating coefficient $\alpha$ or width b and thickness t in the equation (1). However, for achieving consistent tracking accuracy, it is preferable that a correcting function should be provided.

(IV) Correction of mis-tracking

Figure 7:
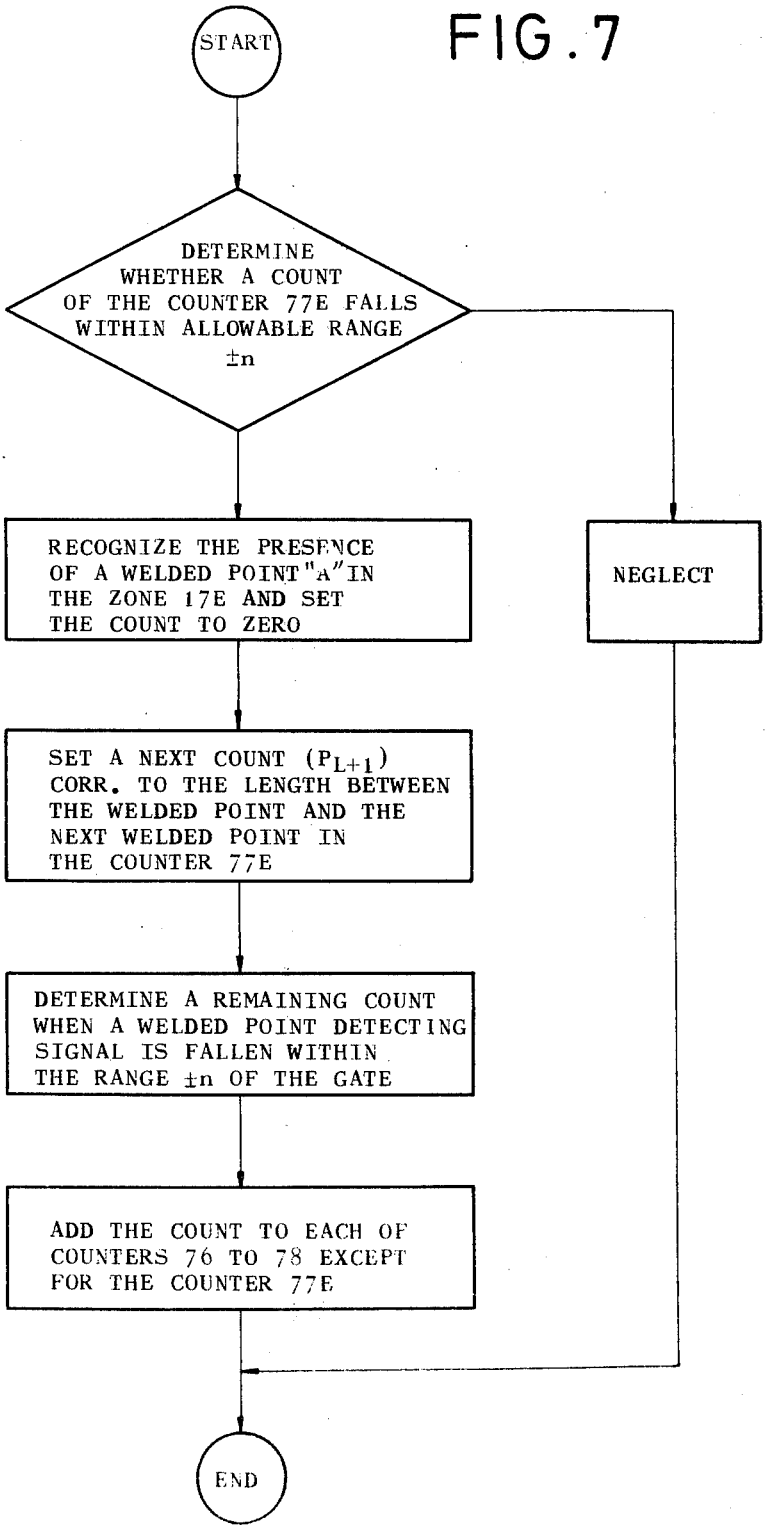
FIG. 7 is a flow chart illustrative of correcting function for tracking error.

The correction of mistracking in general should be conducted for each coil. Upon correction, a detecting signal from the welded joint detector 27 provided on the input side of the heating oven 9, as shown in FIG. 7, is fed into the computer 21 as an interruption signal. Only when the welded joint A derived from the anticipated length L conforms to the welded joint detecting signal from the detector 27, the detecting signal from the detector 27 is received so as to nullify the count value in the presettable counter 77E, whereupon the calculated length L of the trailing steel strip is set. At the same time, correction is made to the error in the presettable counters 76 to 78 (except for 77E) in the zones extending from the preheating zone 16 to the mill zone 18.

The welded point detector 27 consists of: a thickness gage 35 for the steel strip, such as an X-ray thickness gage; a square-law circuit or differentiation circuit 36 for emphasizing a peak in the output thereof; a high band pass filter H.P.F.; and analogue level switch for switching in response to a detecting signal of a level higher or lower than a given level; and a shaping pulse generating circuit 38 for converting an output into a pulse signal.

Figure 10:
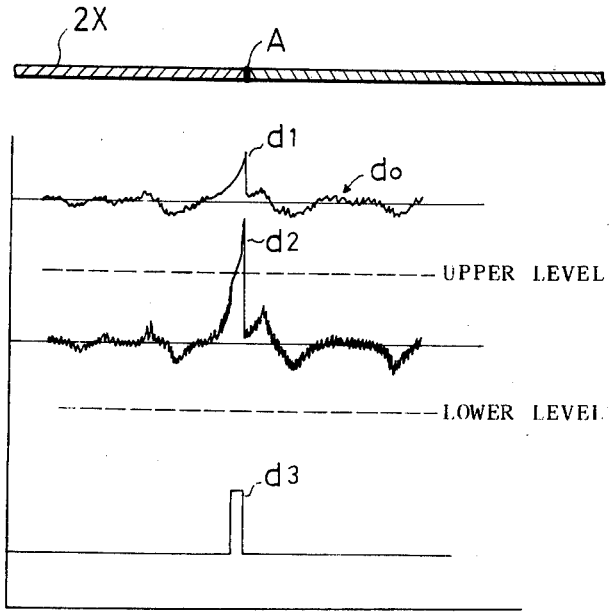
FIG. 10 is a plot showing input and output waveforms representing signal-processing conditions in a welded-joint detector.

The principle of detection is as follows: The thickness of the strip at the welded joint A is larger than the average thickness of the continuous long steel strip because of build-up portions or beads. A thickness $d_0$ of the long steel strip 2X is assumed as being at a normal level, then the thickness $d_1$ of the strip at the welded joint A is abnormal even in the case of the coil 2 conforming to the same specification, with respect to a thickness variation and variation rate. In other words, FIG. 10 shows an output waveform of the X-ray thickness gage 35, and a thickness variation signal for the continuous long steel strip 2X. As can be seen from this, the abnormal level $d_1$ at the welded joint A appears as a sharp peak in contrast to the normal level $d_0$ corresponding to the thickness of the continuous long steel strip 2X.

This signal $d_1$ is emphasized by the differentiation circuit 36 into a signal $d_2$. Then, the signal $d_2$ is fed to the analogue level switch circuit 37. In case the signal $d_2$ deviates from a given level set in the switch circuit 37, then the switch circuit 37 is operated, so that a signal is fed to the pulse generating circuit 38. The signal fed to the pulse generating circuit 38 is converted into pulses in the form of a signal $d_3$.

In this manner, the welded joint detecting signal $d_3$ thus detected is fed to the computer 21 as an interrupting signal. The correcting operation for the computer will be described hereunder.

Figure 8:
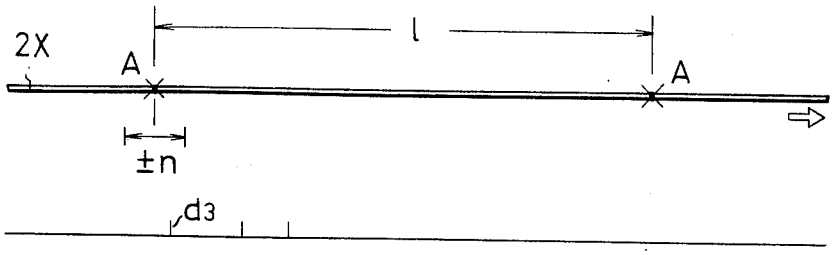
FIG. 8 is a diagram illustrative of the relationship between an open range of the gate and a distance between welded joints.
Figure 9:
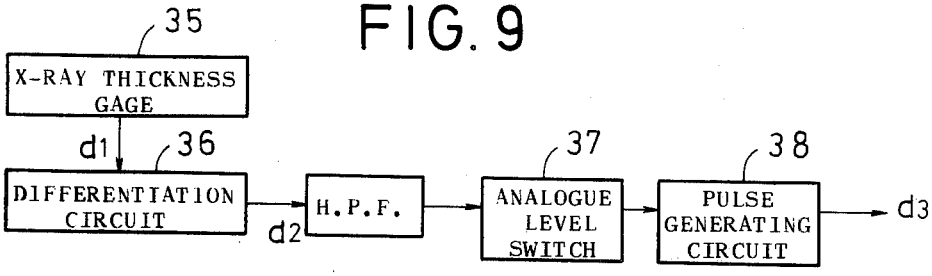
FIG. 9 is a block diagram showing the construction of a welded joint detector.

A gate 39 is connected to the presettable counter 77E in a zone (in this embodiment, heating zone 17), wherein the welded joint detector 27 is provided. In this respect, the gate 39 is functionally provided in computer 21 in the form of software. An open range of the gate 39 is defined by the $\pm n$ counts set fore and aft of a point where the preset value of the calculated length L of the continous long steel strip 2X being fed becomes zero, as shown in FIG. 8. As the continuous long steel strip 2X is being fed, the feed length F given by the feed length gage 26 is subtracted from the preset count value PL, and thus the welded joint detecting signal $d_3$ will pass through the gate 39 only when the welded joint detecting signal $d_3$ falls within a range of $\pm n$ counts. The gate open range n represents a deviation of the actual length l from a calculated length L of the continuous long steel strip 2X, and is determined experimentally. In this embodiment, 15(m) is taken for the value of the gate. The value n is largely affected by the accuracy in the calculated length L and rolling-thickness accuracy in the preceding step. In this embodiment, it is confirmed that the anticipated length determined according to the calculation by the equation (1) includes an error of about 0.5%. Since the average length of the continuous long steel strip 2X is about 1000(m), $1000 \times 0.5 \times \alpha = 15$(m), wherein $\alpha = 3$. The reason why the coefficient $\alpha$ is set to 3 is to insure desired accuracy, even in case the welded joint signal $d_3$ falls in a gate open range $\pm n$, once or twice, rather than to insure provision of a safety factor.

Meanwhile, the modes, in which the welded joint detecting signal $d_3$ falls in a range of $\pm n$ counts may be classified into two cases, i.e., $L + n$, and $L - n$.

(1) in case the detecting signal $d_3$ falls within $L + n$:

In this case, the deviation nl from the calculated length may be obtained in the computer with ease, and then a value (PL + nl) of the value nl plus the preset value Pl which has been set in respective presettable counters 76 to 78 (except for 77E) is reset. The preset value (PL + nl) at this time is an instantaneous value. Accordingly, the subtraction in respective presettable counters 76 to 78 (except for 77E) is conducted nl times more, thus resulting in a delay of nl.

(2) In case the detecting signal $d_3$ falls within $L - n$:

This case is contrary to the foregoing case of $L + n$. In other words, a value (PL − nl) of the preset value PL set in the presettable counters 76 to 78 (except for 77E) less the deviation nl is reset. Accordingly, subtraction in the respective presettable counters 76 to 78 (except for 77E) is conducted nl times earlier.

In addition, in case the welded joint detecting signal $d_3$ does not fall in $L \pm n$, then the actual length l is regarded as the calculated length L ($l = L$). This is because due to high accuracy of the calculated length L, several of the coils 2 may be sufficiently compensated for. In addition, signals $d_4$, $d_5$ which do not fall within the $+n$ counts are neglected as false detecting signals.

In this manner, a deviation of the calculated length L from the actual length l may be corrected, and then the same procedure is repeated for the succeeding continuous long steel strip.

While description has been given thus far of the X-ray thickness gage 35 used for the welded joint detector 27, in case the production line includes a heat treating process, then in place of an X-ray thickness gage, or in combination therewith, a thermometer may be employed. In this respect, the thickness of strip at the welded joint A is greater than the average thickness of the continuous long steel strip 2X, so that there arises a variation in temperature at the welded joint A, after passing through the heat treating process. As a result, a detecting signal produced from the thermometer exhibits a peak at the welded joint as in the case of the X-ray thickness gage. Thus, the same processing as in the preceding case is applied to this detecting signal for detection of the welded joint A.

Description will now be made of tracking in a range from the mill zone 18 to the cooling bed zone 20.

TRACKING FROM THE MILL ZONE 18 TO THE COOLING BED ZONE 20

For tracking over the range from the mill zone 18 to the cooling bed zone 20, since the forged pipe 2Y formed by roll-forming at the mill 10 is cut to a given length by the rotary hot saw 11, the subtraction process for the presettable counters in respective zones is divided for the tracking in a similar manner to the preceding case. In this case, a pipe velocity gage 28 provided between the mill 10 and the rotary hot saw 11 is used as a feed length gage adapted to generate a subtraction pulse in the mill zone 18 and transporting zone 19, so that a pulse is subtracted from the preset value set in the presettable counter 78 each time, for tracking the welded point A.

For tracking over the range from transporting zone to the cooling bed zone 20, a subtraction pulse from the pipe counter 29 provided between the sizer mill 12 and the cooling bed 13 is subtracted from the preset value set in the preset counter 79.

Thus, the results of tracking are utilized as various control factors.

For instance, for allowing an operator in an operating room in the production line to check the movement of the welded joint A, with ease, visually, there may be provided lamp indicators 90 (FIG. 11) corresponding to respective equipments in the production line, so that the lamps corresponding to the position of the welded joint A moving moment by moment may be lit in turn. In addition, information as to of the coil number, type of material, and dimensions of the steel strip moving along with the welded joint A may be derived from the computer, so that such information may be indicated in response to the lamp indicators 90, thereby permitting recognition of the coil information with ease.

In addition, the tracking signals may be employed as automatic control timing signals for respective equipments in the production line. Particularly, the welded joint A is weaker in physical strength than the other portion of the strip, so that the quantity of heat to be applied to the welded joint A during heat treatment in the heating oven 9 should be reduced. In addition, it is essential that the rolling reduction and tension of the continuous long steel strip 2X be slightly reduced at the mill 10.

In such a case, according to the present invention, the presence of the welded joint A may be tracked accurately, so that the respective equipments, through which the welded joint A is anticipated to pass, may be automatically controlled.

Furthermore, the tracking signals may be used as timing signals for information processing. Information as to the material which is continuously subjected to various operations can be stored in the computer 21, so that stock inventory or production efficiency may be controlled in response to the tracking signals.

While description has been thus far given of the tracking process for the welded joint A in a production line of forged pipes, the present invention may be applied to other type production lines, which will be described hereunder.

Figure 12:
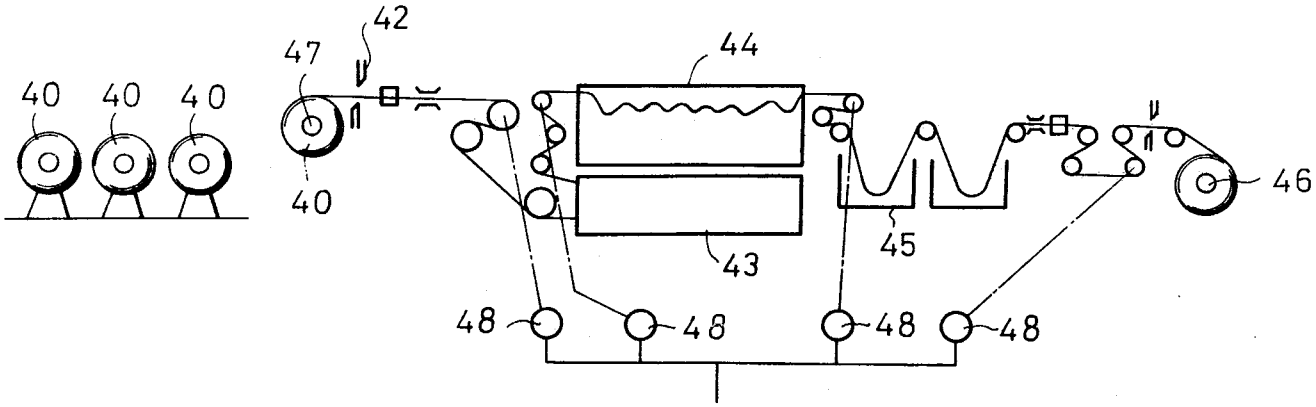
FIG. 12 is a schematic diagram illustrative of the steps of a continuous pickling line.

FIG. 12 is a view illustrative of the the steps carried out in a pickling line. This pickling line includes the steps of: attaching a coiled steel strip 40 to an uncoiler reel 41; welding the end of steel strip 40 to the end of trailing steel strip 40 at a welder 42; storing the long steel strip in a loop floor 43, passing the strip through a pickling tub 44; and water rinsing same in a water tub 45; and taking up same by a reel 46; and delivering the strip for subsequent processing.

The process for tracking in the pickling line varies, to some extent, depending on the length of the line. However, the line is divided into two or more zones in the same manner as that of the preceding embodiment, and then presettable counters are provided for respective zones, so that the anticipated length of the coil 40 is set in the presettable counter, and then a detected length of a steel strip, which has been derived from the feed length gage is subtracted from the preset value in the presettable counter. Thus, tracking of the welded joints may be achieved with high accuracy.

The results of tracking may be processed in a manner similar to the processing of the results of tracking in the steel pipe production line in the preceding embodiment. In the pickling line, the steel strip of a length corresponding to one or two coils is wound around the reel 46, after the water rinsing. Accordingly, the steel strip should be cut in a suitable position to a length corresponding to the length of the coil 40. According to the tracking process of the invention, the tracking signal may be used as a timing control signal for automatic deceleration, automatic shearing, setting of a side guide, and automatic setting of other instruments or automatic machine in the production line.

Figure 13:
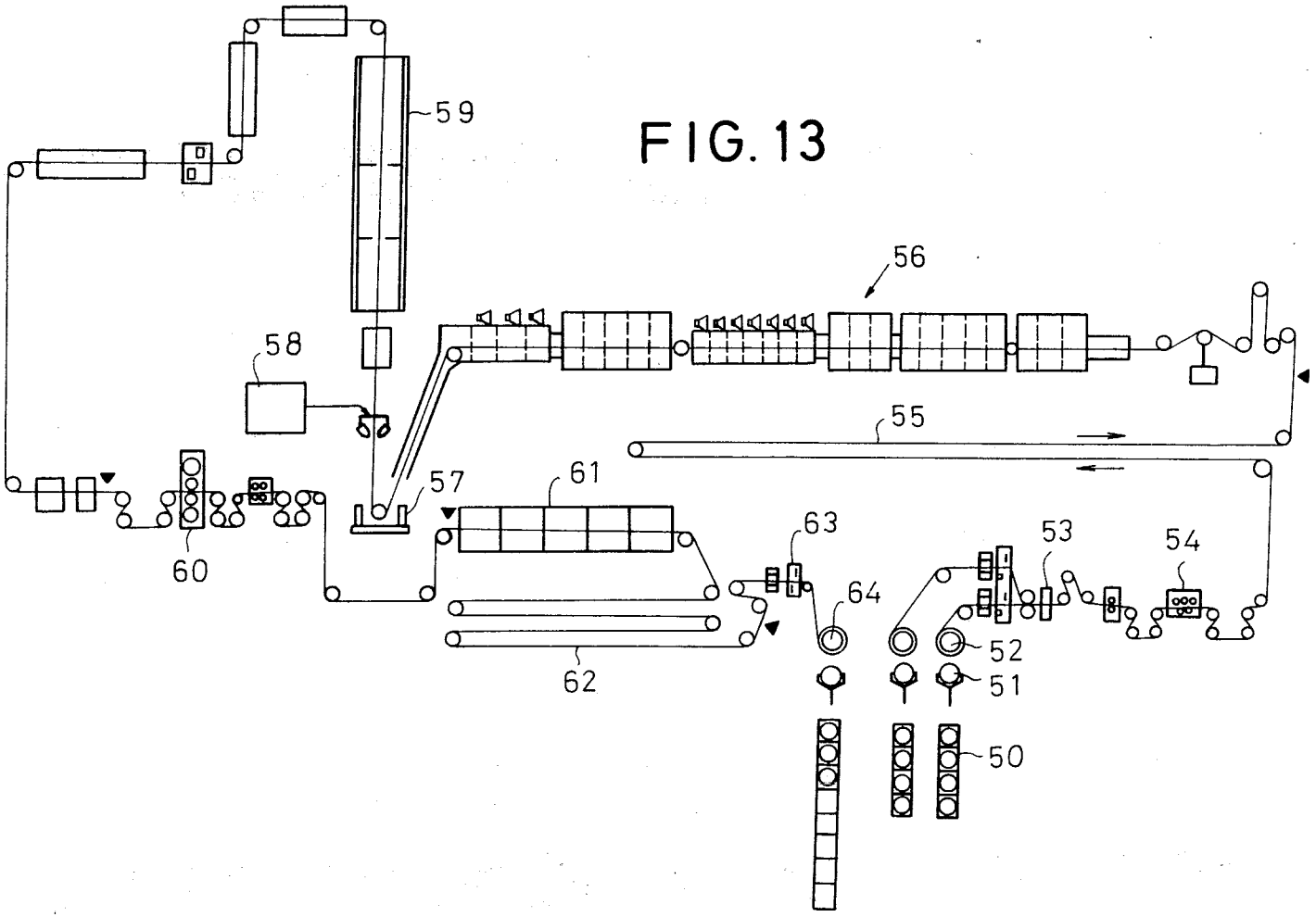
FIG. 13 is a schematic diagram illustrative of the steps of a continuous plating line.

FIG. 13 shows a continuous zinc hot dipping line. In this zinc hot dipping line, as well, the dipping process is divided into two or more zones, and then the welded joint moving moment by moment may be tracked according to subtraction of the length derived from the feed length gage from the preset value in the presettable counter. Particularly, this line includes a heat treating step, so that the tracking of the welded joint is effectively conducted. In this case, although the welded joint is coated with zinc film, the welded joint may be accurately detected according to the tracking process of the present invention. Meanwhile, shown at 50 in FIG. 13 is a material entry conveyor, from which coil 51 is delivered to an uncoiler 52 and then welded by a welder 53. Thereafter, the uncoiled steel strip is delivered via plied roll assembly 54, and a loop car 55 to a continuous annealing heat treating oven 56. The steel strip from the heat heating oven 56 is then plated in the zinc hot dipping tub 57, followed by wiping in a wiping device 58 and passing through a annealing oven 59, then via a temper roll 60 to a chemical conversion tub 61. The steel strip from the chemical conversion tub 61 is delivered via a loop car 62 to a shear 63 for cutting at the welded joint, followed by winding on a tension reel 64. Then, the steel strip in the form of a coil again is delivered by conveyor means to the subsequent stage.

According to the present invention, a welded joint moving moment by moment in the continuous production line may be automatically and accurately tracked. In addition, by dividing the production line into two or more zones, tracking corresponding to respective equipments provided in the production line may be effected. Signals thus processed are fed to respective equipments as control timing signals, so that the working or treatment for the welded joint may be suitably and positively carried out. Still furthermore, in case presettable counters are provided in respective zones, then the length of steel strip fed is subtracted from the preset counts of an anticipated length of the actual continuous long steel strip, thereby enabling tracking accurately in a rapid reliable manner. Yet furthermore, a welded joint detector is provided for correcting the aforesaid preset counts for achieving improved accuracy of detection and reliability. According to the tracking process of the present invention, there is no need to put markings, and to contact the steel strip directly. As a result, there is no possibility of a product being damaged, with the accompanying improvements in quality of products.

What is claimed is:

1. A process for tracking a welded joint in a continuous length of material while feeding same at a given feeding speed on a continuous production line in which two or more presettable counters are spaced apart from each other on the production line in the feeding direction thereof, said continuous length of material consisting of equal elementary lengths joined together lengthwise by welding, comprising the steps of:

calculating an anticipated length of each elementary length on the basis of the weight, type of material, width and thickness of said elementary length and presetting a count value corresponding to the length thus calculated in said presettable counters to which the welded joint is transported;

subtracting a count value corresponding to the actual feed length of the continuous length of material from said count value preset in each of said presettable counters, while feeding said continuous length of material;

making an assumption that said welded joint is present at the position in said production line of the presettable counter for which the result of said subtraction is zero; and making a correction of said assumption of the presence of said welded joint, said correction being made by the steps consisting of:

detecting a welded joint without contacting same in one or more positions on said production line;

setting for a presettable counter corresponding to a position, in which said welded joint has been detected, a gate range covering $\pm n$ counts, with a center of said range being taken at a position where the result of said subtraction is zero, thereby assuming that the welded joint is present at a position of the presettable counter corresponding to said detection position only when both the position at which the result of said subtraction is zero and the position at which a detection signal is derived are present at the same time; and determining a deviation of the position at which a welded-joint detecting signal is produced as an output from the position at which the result of said subtraction is zero, within said gate range, and adding or subtracting a count value corresponding to said deviation to or from the count value preset in each of said presettable counters.

2. A process as set forth in claim 1, wherein the presettable counters are provided for respective equipments on said production line.

3. A process as set forth in claim 1, wherein the length 'L' of the elementary length is estimated by calculating according to the following formula:

$$L = \alpha \times (w \times 10^{-2}/pbt)$$

wherein,

L: anticipated length (m)

W: mass of material (g)

t: average thickness of material (cm)

p: specific gravity $\approx 7.9$ (g/cm$^3$)

$\alpha$: compensating factor $\approx 1.0$ b: width of coil (cm)

4. A process as set forth in claim 1, wherein the detection of a welded joint without contacting same is effected by detecting a variation in the thickness of the continuous length of material undergoing feeding.

5. A process as set forth in claim 4, wherein the detection of a variation in thickness is effected in response to radiating X-rays through the continuous length of material being fed.

6. A process as set forth in claim 4, wherein the detection of a variation in thickness is effected by measuring a temperature distribution in the longitudinal direction of the continuous length of material being fed.

7. A process as set forth in claim 1, wherein said process is applied to a continuous production line for a continuous steel pipe.

8. A process as set forth in claim 1, wherein said process is applied to a continuous pickling line for a continuous steel material.

9. A process as set forth in claim 1, wherein said process is applied to a continuous plating line for a continuous steel material.

10. A process as set forth in claim 1, wherein said process is applied to a continuous annealing line for a continuous steel material.

11. An apparatus for tracking a welded joint in a continuous length of a material while feeding same at a given feeding speed on a continuous production line in which two or more presettable counters are spaced apart from one another on the production line in the feeding direction thereof, said continuous length of material consisting of equal elementary lengths joined together in the longitudinal direction thereof by welding, comprising:

computing means for estimating the length of each of said elementary lengths;

means for converting the value obtained from the computing means into a pulse count value and presetting said pulse count value in each of said presettable counters;

speed detecting means for detecting the feed length from the feeding speed of said continuous length of material;

means for converting the value detected by said speed detecting means into a pulse count value and subtracting said pulse count value from the pulse count value preset in each of said presettable counters, as said continuous length of material is being fed;

means for resetting a pulse count value corresponding to an estimated length of the elementary length which corresponds to a distance from a leading welded joint to a trailing welded joint when one welded joint moves past a presettable counter and a pulse count value in the presettable counter is zero; and, means for correcting the reset pulse count value including:

a non-contacting type, welded joint detector for detecting the actual welded joints in one or more positions on said production line;

comparing means having a gate range of $\pm n$ count, with the center of said range being taken at a position along said production line at which the result of the subtraction is zero, said comparing means being provided for determining a deviation of the position at which the result of said subtraction is zero from the position at which a detection output is produced from said detector; and computing means for adding or subtracting a pulse count value corresponding to the deviation output of said comparing means to or from said reset pulse count value.

12. An apparatus as set forth in claim 11, wherein the non-contacting type welded joint detector in said correction means detects a welded joint by means of a thickness gage for detecting a variation in thickness of said continuous length of material being fed.

13. An apparatus as set forth in claim 12, wherein the thickness gage in said welded joint detector is an X-ray thickness gage.

14. An apparatus as set forth in claim 11, wherein the non-contacting type welded joint detector in said correction means detects a welded joint by means of a thermometer for detecting a temperature gradient in the longitudinal direction of said continuous length of material being fed.

15. An apparatus as set forth in claim 11, wherein the non-contacting type welded joint detector in said correction means includes a circuit for differentiating a detection signal from said detector, a comparator for comparing a mean thickness level of said continuous length of material with said detection signal, and a one-shot pulse generator converting the deviation output of said comparing means into a pulse signal.

16. An apparatus as set forth in claim 11, wherein indicators are provided in opposed relation to the presettable counters and capable of indicating the condition of the welded joints being fed past said counters.

* * * * *